US009151091B2

(12) United States Patent
Hinderliter et al.

(10) Patent No.: US 9,151,091 B2
(45) Date of Patent: Oct. 6, 2015

(54) ACTUATOR MECHANISM FOR DOOR LATCH

(75) Inventors: Derick L. Hinderliter, Mapleton, IL (US); Dale B. Higdon, Dunlap, IL (US); Pradipkumar J. Tanpure, Peoria, IL (US); Raymond D. Hendrix, Charles City, IA (US)

(73) Assignee: Caterpillar Inc., Peoria, IL (US)

( * ) Notice: Subject to any disclaimer, the term of this patent is extended or adjusted under 35 U.S.C. 154(b) by 556 days.

(21) Appl. No.: 13/537,139

(22) Filed: Jun. 29, 2012

(65) Prior Publication Data

US 2014/0001776 A1 Jan. 2, 2014

(51) Int. Cl.

| | |
|---|---|
| ***E05B 3/00*** | (2006.01) |
| ***E05B 85/16*** | (2014.01) |
| ***E05B 83/42*** | (2014.01) |
| ***E05B 85/12*** | (2014.01) |

(52) U.S. Cl.

CPC ..... *E05B 85/16* (2013.01); *E05B 83/42* (2013.01); *E05B 85/12* (2013.01); *Y10T 292/57* (2015.04); *Y10T 292/702* (2015.04)

(58) Field of Classification Search

CPC ..... E05B 15/02; E05B 79/10; E05B 79/16; E05B 79/22; E05B 83/42

USPC ..... 292/336.3, 194, 195, 198, 200, 216

See application file for complete search history.

(56) References Cited

U.S. PATENT DOCUMENTS

| | | | | |
|---|---|---|---|---|
| 2,117,192 | A | 5/1938 | McClung | |
| 3,843,175 | A * | 10/1974 | Klebba | 292/216 |
| 4,038,718 | A | 8/1977 | Reilhac | |
| 4,896,906 | A * | 1/1990 | Weinerman et al. | 292/48 |
| 4,917,412 | A * | 4/1990 | Swan et al. | 292/48 |
| 5,069,491 | A * | 12/1991 | Weinerman et al. | 292/48 |
| 5,117,665 | A * | 6/1992 | Swan et al. | 70/264 |
| 5,259,652 | A | 11/1993 | Adams | |
| 5,504,974 | A | 4/1996 | Graber | |
| 6,264,257 | B1 * | 7/2001 | Meinke | 292/336.3 |
| 6,494,506 | B1 * | 12/2002 | Gleason et al. | 292/216 |
| 7,950,703 | B2 | 5/2011 | Marko | |
| 2001/0024041 | A1 * | 9/2001 | Barczynski et al. | 292/216 |
| 2004/0113441 | A1 * | 6/2004 | Lane et al. | 292/336.3 |
| 2005/0212307 | A1 * | 9/2005 | Lane et al. | 292/336.3 |

* cited by examiner

*Primary Examiner* — Kristina Fulton
*Assistant Examiner* — Christine M Mills
(74) *Attorney, Agent, or Firm* — BakerHostetler

(57) ABSTRACT

An actuator mechanism for a door latch is provided. The actuator mechanism may include a first actuator and a second actuator. The first actuator can be pivotably coupled to a first support structure about a first axis. Moreover, the first actuator can include an engaging tip, a first engagement and a second engagement. The second actuator can be pivotably coupled to a second support structure about a second axis. In response to the movement of the arm of the second actuator about the second axis, the first engagement of the first actuator can rotate about the first axis to move the engaging tip to release the door latch. Alternatively, in response to the movement of the second engagement of the first actuator, the second engagement of the first actuator can rotate about the first axis to move the engaging tip to release the door latch.

20 Claims, 13 Drawing Sheets

ACTUATOR MECHANISM FOR DOOR LATCH

TECHNICAL FIELD

The present disclosure relates to unlatching of a door of an operator cabin, and more particularly to an actuator mechanism for releasing a door latch.

BACKGROUND

Typically, a relatively large handle effort is required to open a cab door of a construction machine. Contributing factors can include low mechanical advantage offered by current handle designs and existence of friction between components of a latch. For example, U.S. Pat. No. 5,117,665 relates to a vehicle door lock system including interior and exterior handle assemblies that are accessible, respectively, from interior and exterior sides of a vehicle door. The door lock system includes a rotary latch that is configured to releasably engage a door-frame-mounted striker to "latch" and "unlatch" the door. The door is "locked" and "unlocked" by selectively enabling and disabling driving connections between the handle assemblies and separate release arms of the rotary latch. More specifically, locking and unlocking of the door are affected either by operating an exterior key cylinder, or by operating an interior sill button.

SUMMARY OF THE DISCLOSURE

In one aspect of the present disclosure, an actuator mechanism for a door latch is provided. The actuator mechanism may include a first actuator and a second actuator. The first actuator can be pivotably coupled to a first support structure about a first axis. Moreover, the first actuator can include an engaging tip to release a door latch. The first actuator can also include a first engagement and a second engagement, each of the first and second engagement spaced from the first axis. The second actuator can be pivotably coupled to a second support structure about a second axis. The second axis may be different than the first axis. Further, the second actuator can include an arm configured to selectively engage the first engagement of the first actuator. In response to the movement of the arm of the second actuator about the second axis, the first engagement of the first actuator can rotate about the first axis to move the engaging tip to release the door latch. Alternatively, in response to the movement of the second engagement of the first actuator, the second engagement of the first actuator can rotate about the first axis to move the engaging tip to release the door latch.

In another aspect, a method for releasing a latch is provided. The method applies an actuation force to a first handle or a second handle. The first handle may be coupled to a second engagement of a first actuator and the second handle may be configured to be coupled to a second actuator. The method rotates the first actuator about a first axis to move an engaging tip of the first actuator to a position to release the latch when the actuation force is applied to the first handle. The engaging tip can be selectively engageable within the latch. The method rotates an arm of the second actuator about a second axis to engage a first engagement of the first actuator when the actuation force is applied to the second handle to cause rotation of the first actuator about the first axis such that the engaging tip is moved to a position to release the latch. The arm of the second actuator may be configured to selectively engage the first engagement of the first actuator.

Other features and aspects of this disclosure will be apparent from the following description and the accompanying drawings.

DETAILED DESCRIPTION

Figure 1:
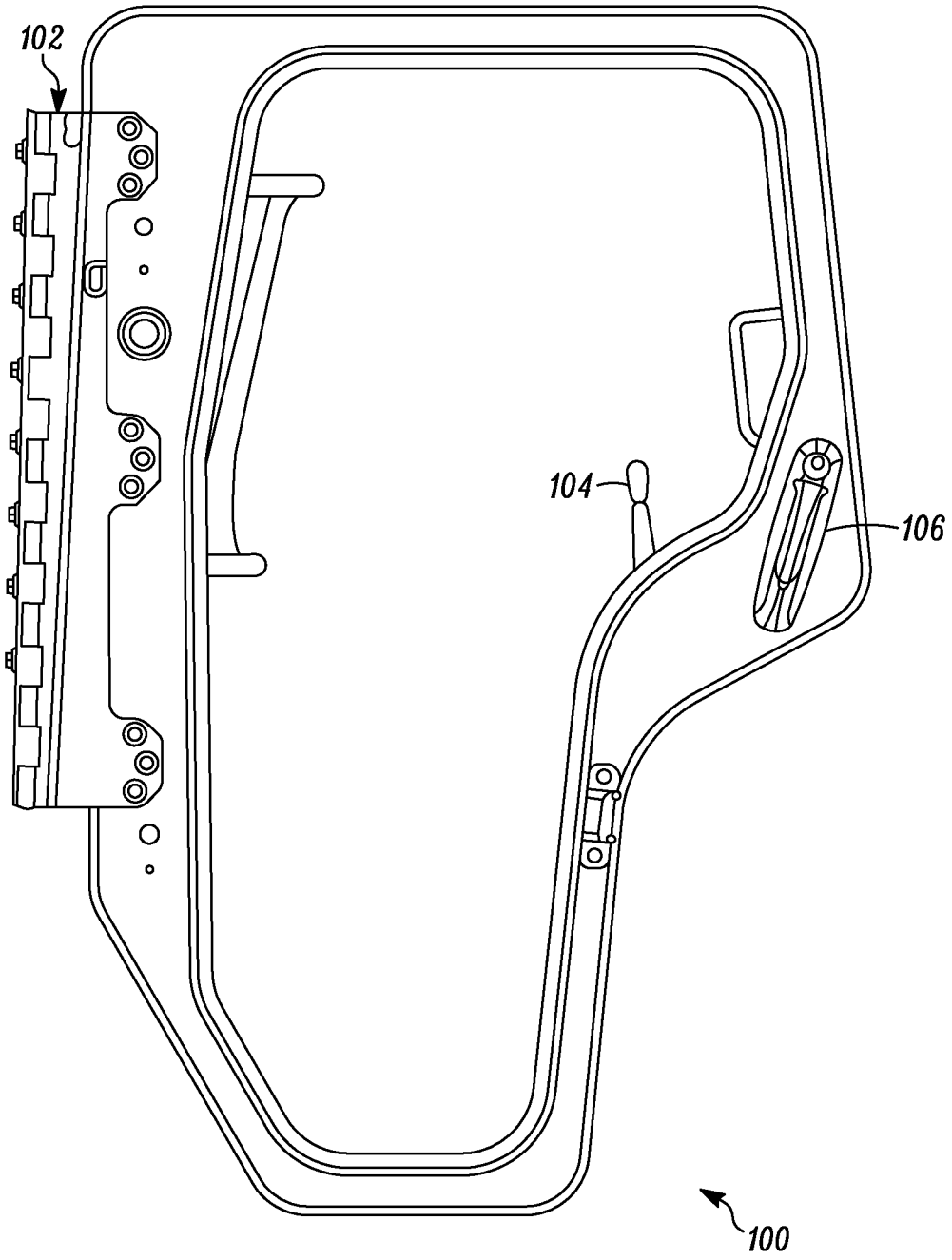
FIG. 1 is a diagrammatic outside view of an exemplary door, according to one embodiment of the present disclosure.
Figure 2:
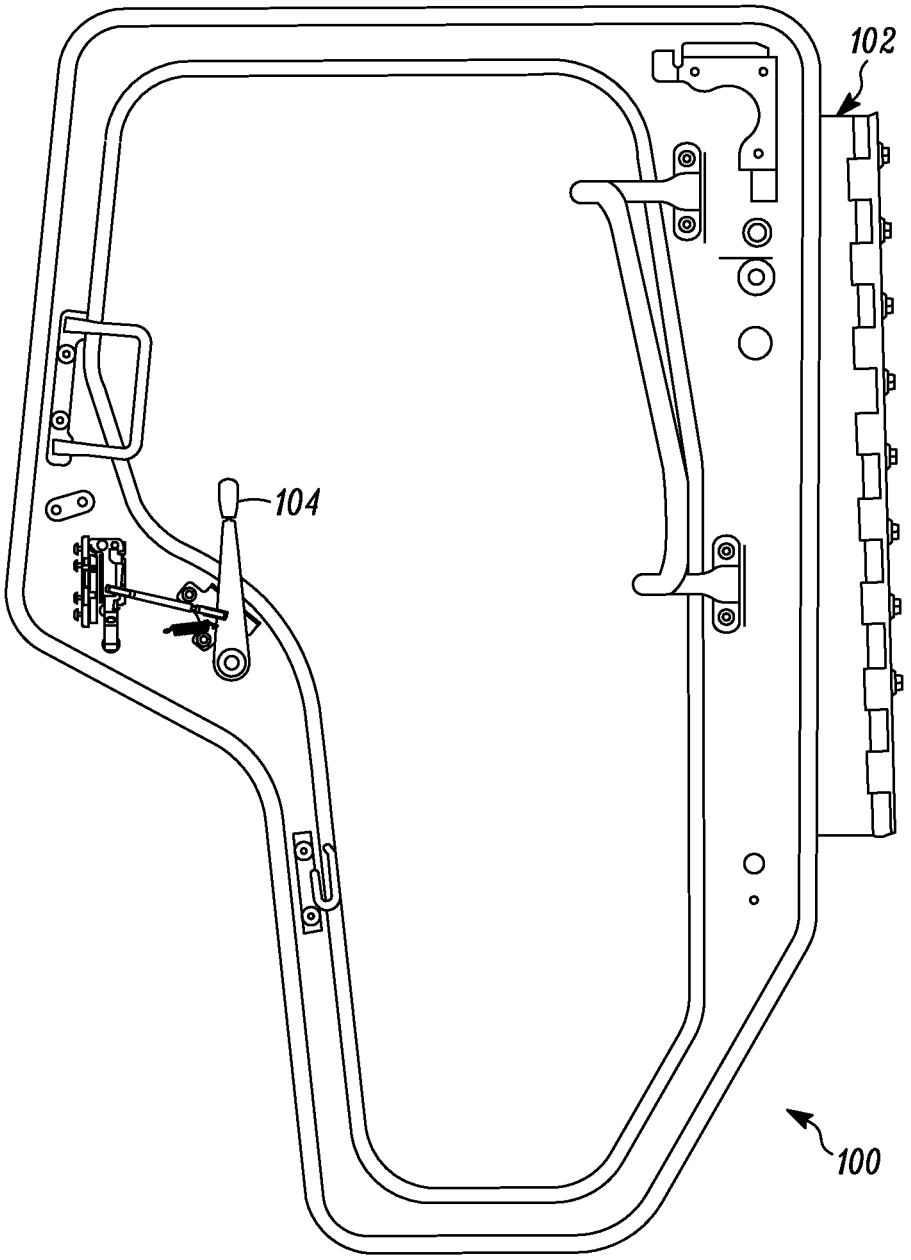
FIG. 2 is a diagrammatic inside view of the door shown in FIG. 1.

Wherever possible, the same reference numbers will be used throughout the drawings to refer to the same or like parts. FIGS. 1-2 illustrate an outside and inside view, respectively, of an exemplary door 100, according to one embodiment of the present disclosure. The door 100 may be representative the door 100 of an operator cabin of a machine, such as, for example, a tractor, a wheel loader, a dozer, a motor grader, or any other construction machine. The door 100 may be configured to rotate about a hinge 102 between an open position and a closed position such that the operator can ingress and egress from the operator cabin. A latch may be associated with the door 100, as will be described herein.

Referring to FIGS. 1-2, a first handle 104 may be coupled to the latch, such that application of a first actuation force on the first handle 104 can release the latch to allow the door 100 to be opened. In one embodiment, the first handle 104 may be located on the inside of the door 100. In another embodiment, a second handle 106 may also be coupled to the latch. On exerting a second actuation force on the second handle 106, the latch may be released to allow the door 100 to be opened. The second handle 106 may be located on the outside of the door 100 as shown in FIG. 1. It should be noted that the first and second handles 104, 106 described herein are exemplary. Orientation, size and positioning of the first and second handles 104, 106 may vary. A person of ordinary skill in the art will appreciate that at any instant of time, any one of the first or second handles 104, 106 can be used to open the door 100.

Figure 3:
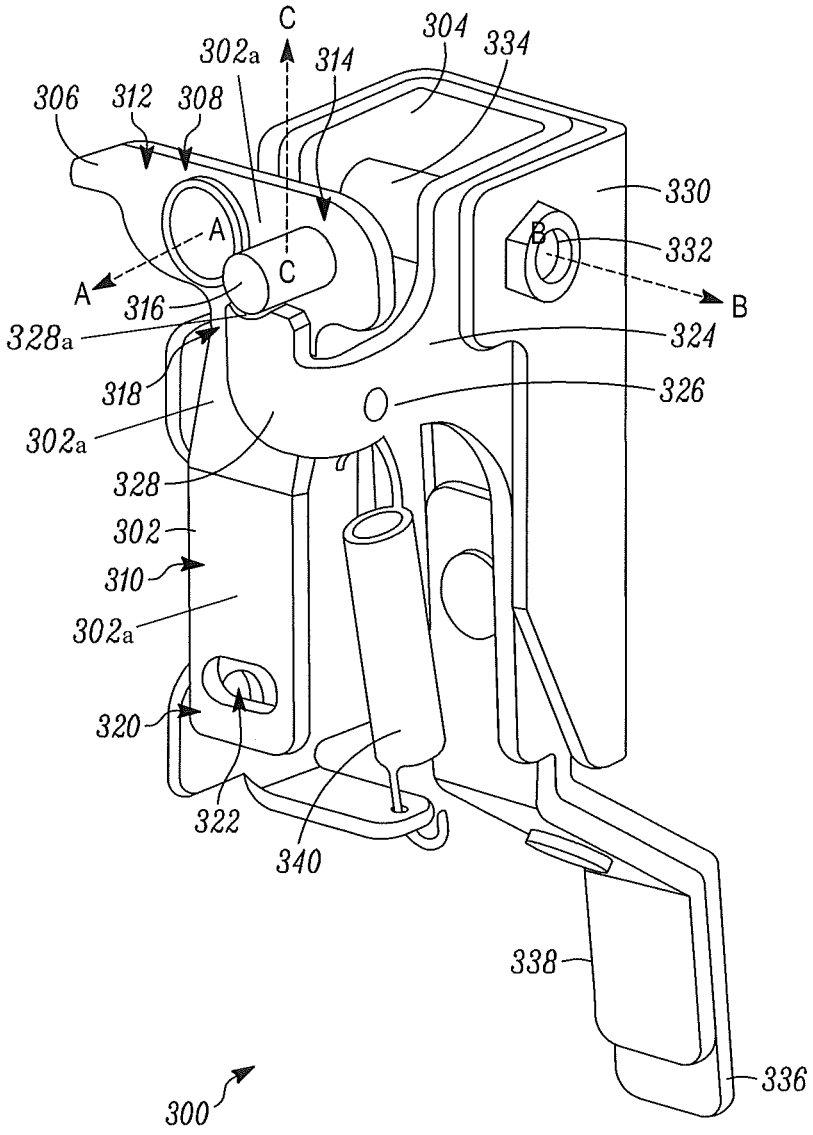
FIG. 3 is an exploded view of the actuator mechanism.
Figure 4:
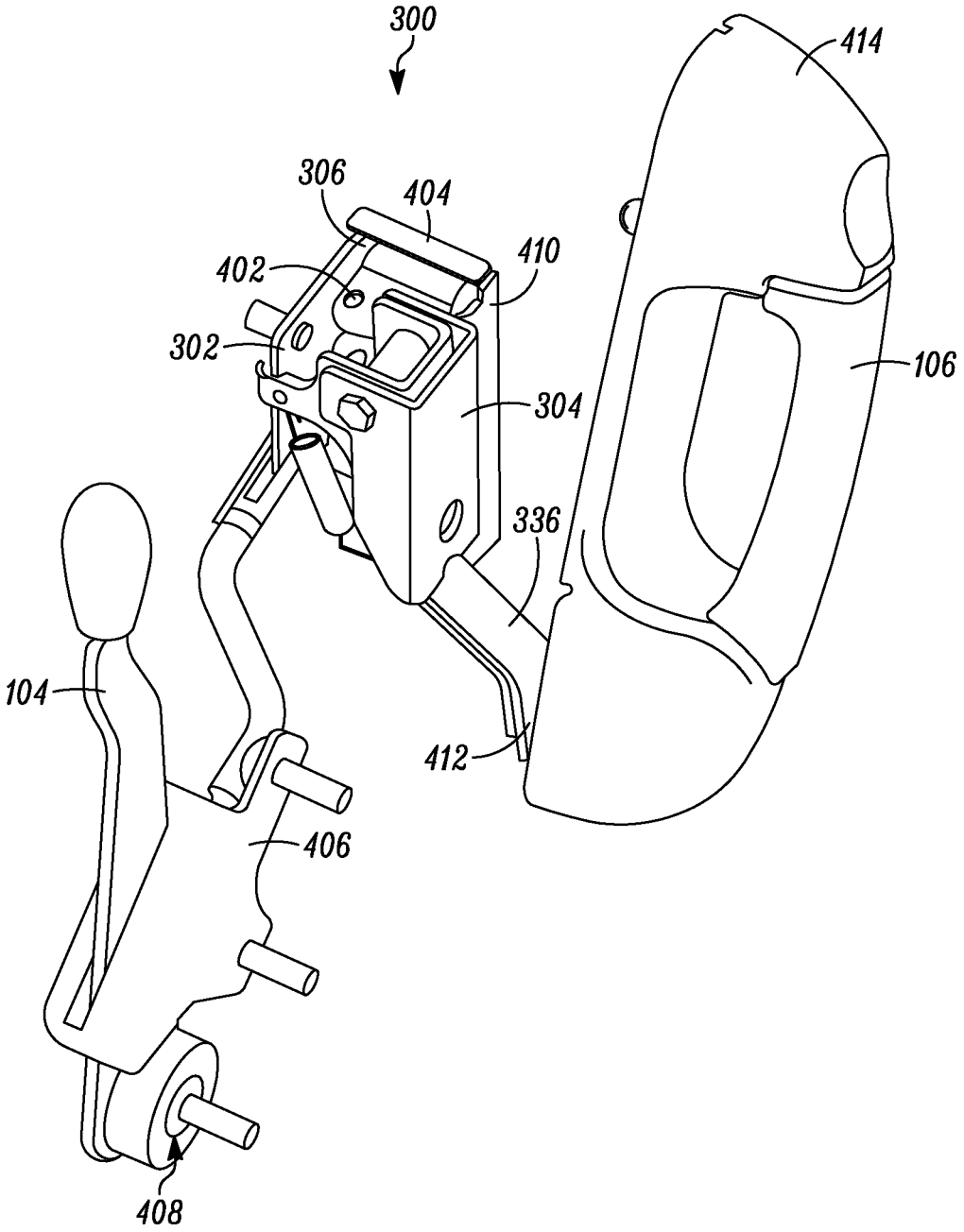
FIG. 4 is a perspective view of an actuator mechanism, a latch, a first handle and a second handle.

FIGS. 3-4 depict one example of an actuator mechanism 300 for the latch. The actuator mechanism 300 is configured to release the latch on application of any one of the first or second actuation forces on the first or second handles 104, 106 respectively. In one embodiment, the actuator mechanism 300 can include a first actuator 302 and a second actuator 304. The first actuator 302 may be pivotably coupled to a first support structure 402 (shown in FIG. 4). Moreover, the first actuator 302 can be configured to pivot about a first axis AA of rotation.

In one embodiment, the first actuator 302 may include an engaging tip 306. The engaging tip 306 can be configured for selective engagement within a latch 404. For example, the latch 404 may be released in response to a movement of the engaging tip 306, such as vertical movement caused by pivoting of the first actuator 302 about the first axis AA. In yet another embodiment, the first actuator 302 may include a first leg 308 and a second leg 310 coupled to one another in an intersecting manner, in the form of a "T"-shaped member. The first leg 308 can include a first end 312 and a second end 314. The first end 312 may include the engaging tip 306. The second end 314 may include a first engagement 316 extending from a surface 302*a* of the first actuator 302 on a side of the first actuator 302 facing in a direction along the first axis AA. The first engagement 316 can be spaced from the first axis AA, such that the first axis AA is positioned between the engaging tip 306 and the first engagement 316, as shown in FIG. 3. In one embodiment, the first engagement 316 may include a protrusion, such as a cylindrical body shown extending from and fixedly attached to the first actuator 302.

The second leg 310 of the first actuator 302 may include a first end 318 coupled between the first and second ends 312, 314 of the first leg 308 and a second end 320 having a second engagement 322. The second engagement 322 of the first actuator 302 may be spaced from the first axis AA. In one embodiment, the second engagement 322 may include an opening formed in the second leg 310 of the first actuator 302. The opening may be an elongated opening such as a slot as will be described herein. In one embodiment, the second engagement 322 can be selectively moveable along a second axis BB of rotation positioned on a side of the first actuator 302 opposite to the side including the surface 302*a*. In another embodiment, the second engagement 322 may be spaced from the first axis AA along a third axis CC of rotation.

Figure 5:
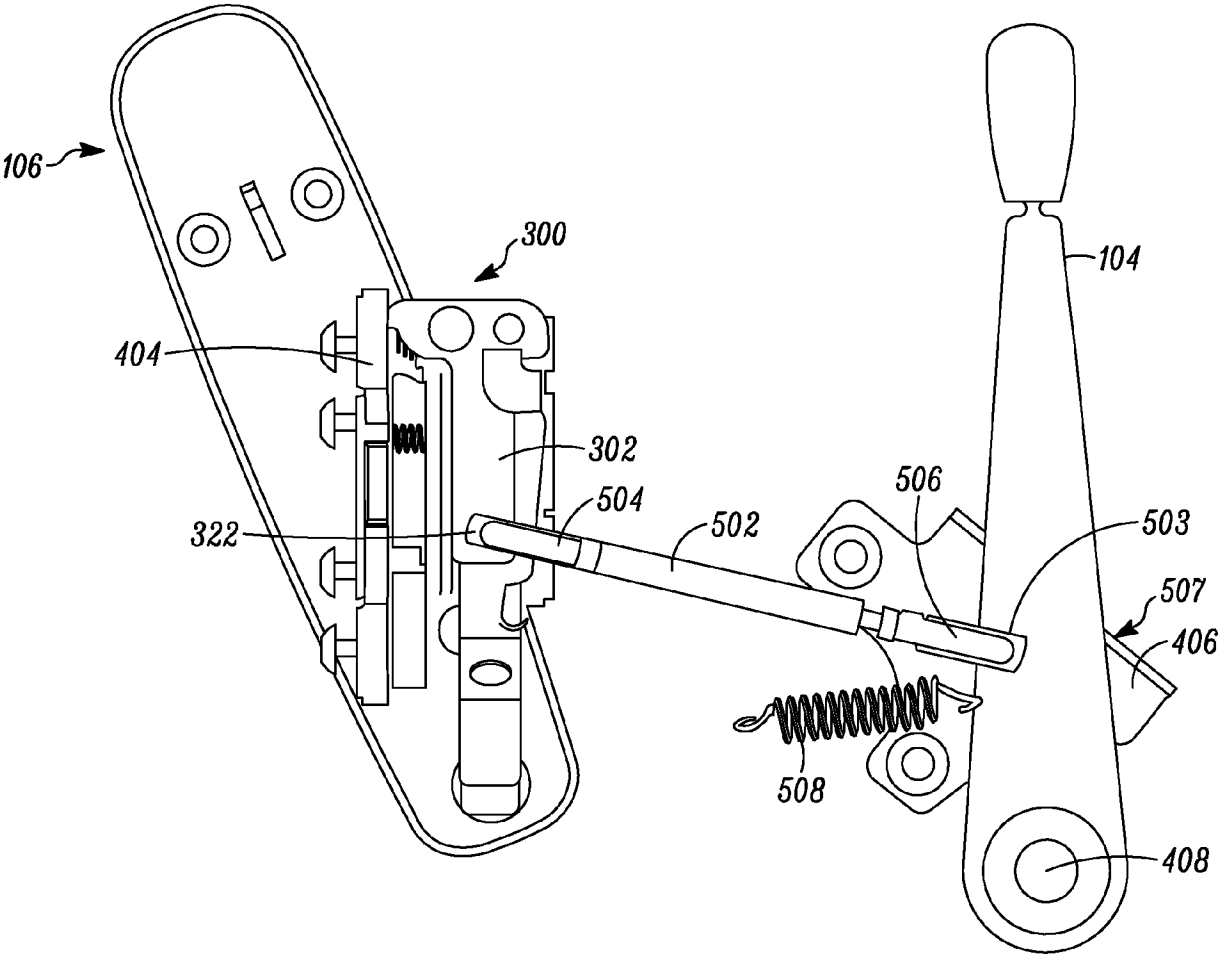
FIG. 5 is a side view of the actuator mechanism shown in FIG. 4 from the inside.

As shown in FIG. 5, a connecting rod 502 may be coupled between the first handle 104 and the second engagement 322 of the first actuator 302. In one embodiment, the connecting rod 502 may be disposed in a direction relative to the second axis BB. The connecting rod 502 may include a first end 504 and a second end 506. The first end 504 of the connecting rod 502 may be engaged with the second engagement 322 (shown as a slot) whereas, the second end 506 of the connecting rod 502 may be engaged within a slot 503 formed in the first handle 104. To this end, the slot 503 may be sized to permit movement of corresponding first and second ends 504, 506 of the connecting rod 502.

Referring to FIGS. 4-5, the first handle 104 may be pivotably coupled to a third support structure 406, allowing the first handle 104 to rotate relative to a handle axis generally in the same direction as the first axis AA. In one embodiment, the third support structure 406 may include a guiding bracket. Referring to FIG. 5, the third support structure 406 may include a slot 507 formed therein sized to permit movement of the first handle 104 within the slot 507, in response to rotation of the first handle 104 about a boss 408. The ends of the slot 507 may define physical stops that define the extent of movement of the first handle 104. In one embodiment, a biasing member 508, such as a spring, may be coupled between the door frame (not shown) and the third support structure 406 to bias the first handle 104 at an initial position. It should be noted that FIGS. 4-5 represent the arrangements between the first handle 104 and the actuator mechanism 300, the second handle 106 and the actuator mechanism 300, as well as the coupling between the actuator mechanism 300 and the latch 404. In these figures, the door 100 has been omitted merely for the purpose of clarity.

In one embodiment, application of the first actuation force by the operator on the first handle 104 in a lateral direction generally the same as the second axis BB can urge the connecting rod 502 to move. In response to the movement of the connecting rod 502, the second engagement 322 of the first actuator 302 can rotate about the first axis AA in a suitable manner to cause the engaging tip 306 to move to a position to release the latch 404. A more detailed explanation will be provided in connection with FIG. 8.

Referring to FIGS. 3-4, the second actuator 304 may be pivotably coupled to a second support structure 410. In another embodiment, the second actuator 304 may be configured to pivot about the second axis BB of rotation. As shown, the second axis BB may be different from and substantially transverse to the first axis AA.

Moreover, the second actuator 304 can include an arm 324 configured to selectively engage the first engagement 316 of the first actuator 302. In one embodiment, the arm 324 may include a first portion 326 extending across the first actuator in a direction along the first axis AA toward the inside. Further, the arm 324 may include a second portion 328 extending upward in a direction along the third axis CC. The second portion 328 may include an engaging surface 328*a* that faces in the direction along the third axis CC and selectively comes into engagement with the first engagement 316 of the first actuator 302. The second portion 328 may include a non-engaging surface 328*b* connected to the engaging surface 328*a* and facing in the direction along the first axis AA. The non-engaging surface 328*a* may extend in the direction along the third axis CC from the engaging surface 328*a* and face the surface 302*a* of the first actuator 302. At least a portion of the non-engaging surface 328*b* may be spaced apart from the surface 302*a* of the first actuator 302 in the direction along the first axis AA. In another embodiment, the second portion 328 is configured to selectively engage the first engagement 316 of the first actuator 302 with the engaging surface 328*a* to move the first engagement 316 of the first actuator 302 along the third axis CC. It should be noted that the third axis CC may be substantially transverse to the first axis AA and the second axis BB, as shown in the accompanied drawings.

In one embodiment, the second actuator 304 may have a C-shaped cross section. Further, the second actuator 304 may include a housing 330. In another embodiment, the second actuator 304 may be coupled to the housing 330 at a pivot point 332. A pivot axle 334 associated with the pivot point 332 is shown in the accompanied figures. The housing 330 may have a C-shaped cross section, such that the second actuator 304 may fit or be nested within the housing 330.

The second actuator 304 may additionally include a lever member 336 extending away and downward from the first actuator 302 in a direction along the third axis CC. In one embodiment, the lever member 336 may be fixed in a secure manner with the second actuator 304. In another embodiment, an additional plate 338, such as, for example, a doubler plate, may be fitted on the lever member 336 to provide increased mechanical strength to the lever member 336. Additionally, a biasing member 340, such as a return spring, may be coupled between the second actuator 304 and the second support structure 410. The biasing member 340 may be configured to bias the second actuator 304 at an initial position.

As shown in FIG. 4, a portion of the second handle 106, such as a lower portion, may selectively engage a tip 412 of the lever member 336. Moreover, the second handle 106 may be pivotably coupled to a handle housing 414, such that the second handle 106 is configured to rotate relative to the second axis BB. In one embodiment, in response to the movement of the second handle 106, the tip 412 of the lever member 336 can be moved in a direction along the first axis AA towards the inside to cause rotation of the second actuator 304 about the second axis BB. To this end, the arm 324 of the second actuator 304 can be moved about the second axis BB to urge the first engagement 316 of the first actuator 302 to rotate about the first axis AA, causing the engaging tip 306 to move to the position to release the latch 404. A more detailed explanation of the releasing of the latch 404 based on the movement of the second handle 106 is described in connection with FIGS. 9-10.

Figure 6:
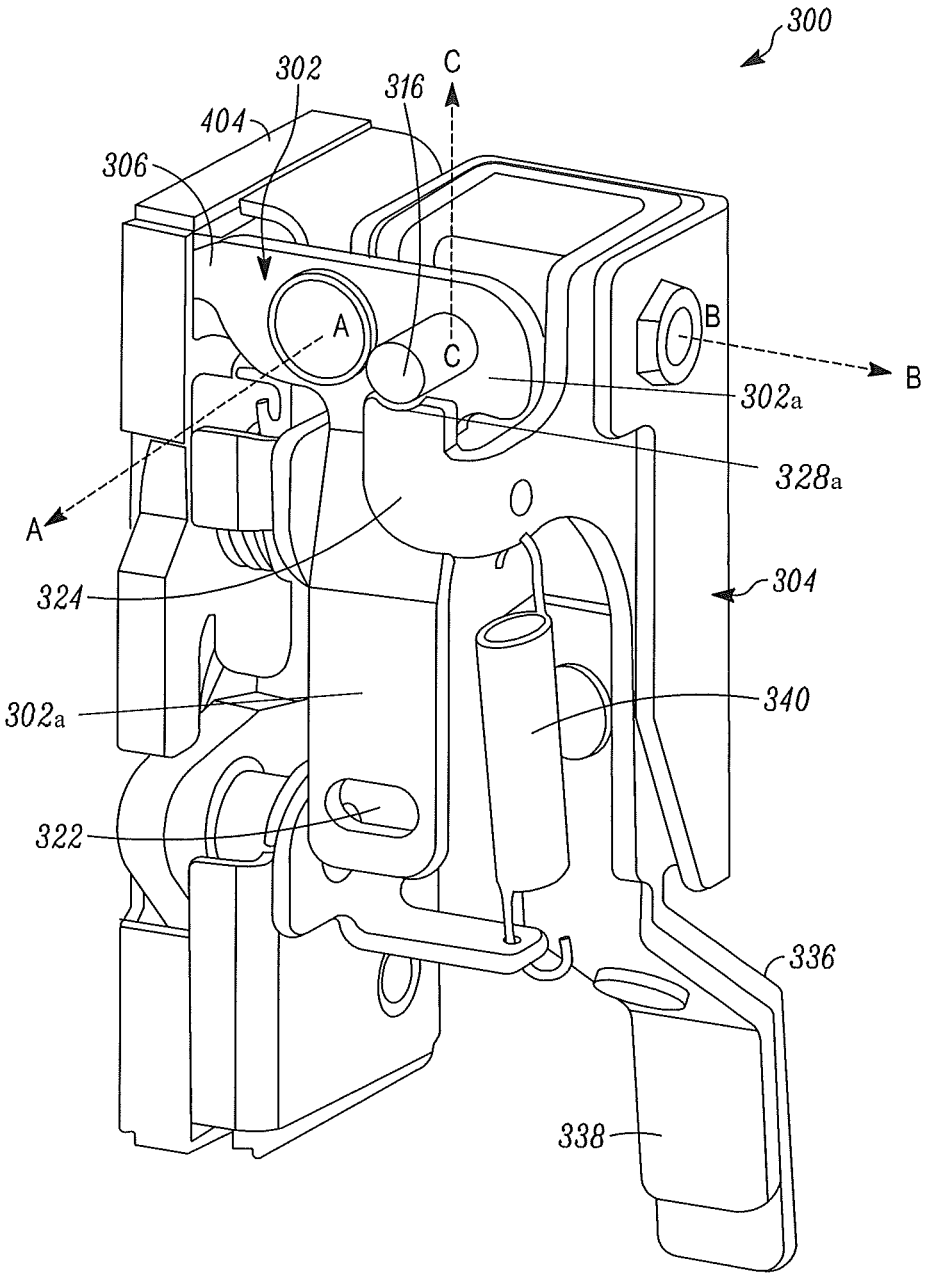
FIG. 6 is a diagrammatic view of the actuator mechanism of FIG. 3 coupled to the latch.
Figure 7:
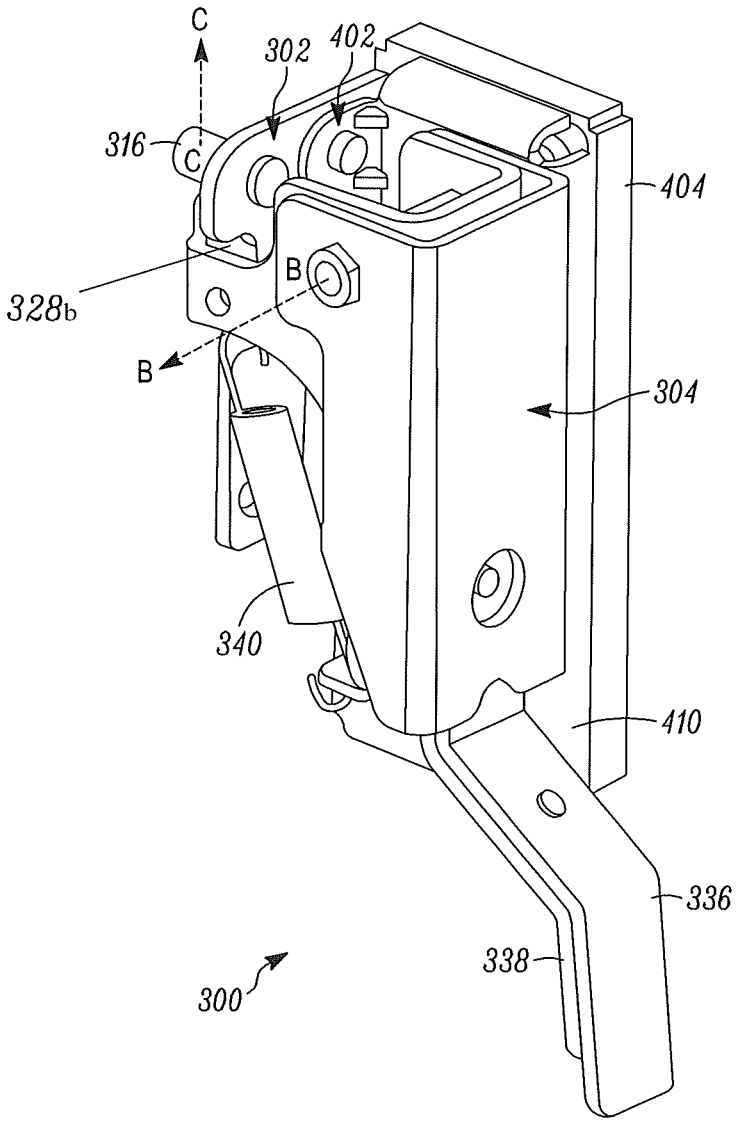
FIG. 7 is an another view of the actuator mechanism and the latch shown in FIG. 6.
Figure 8:
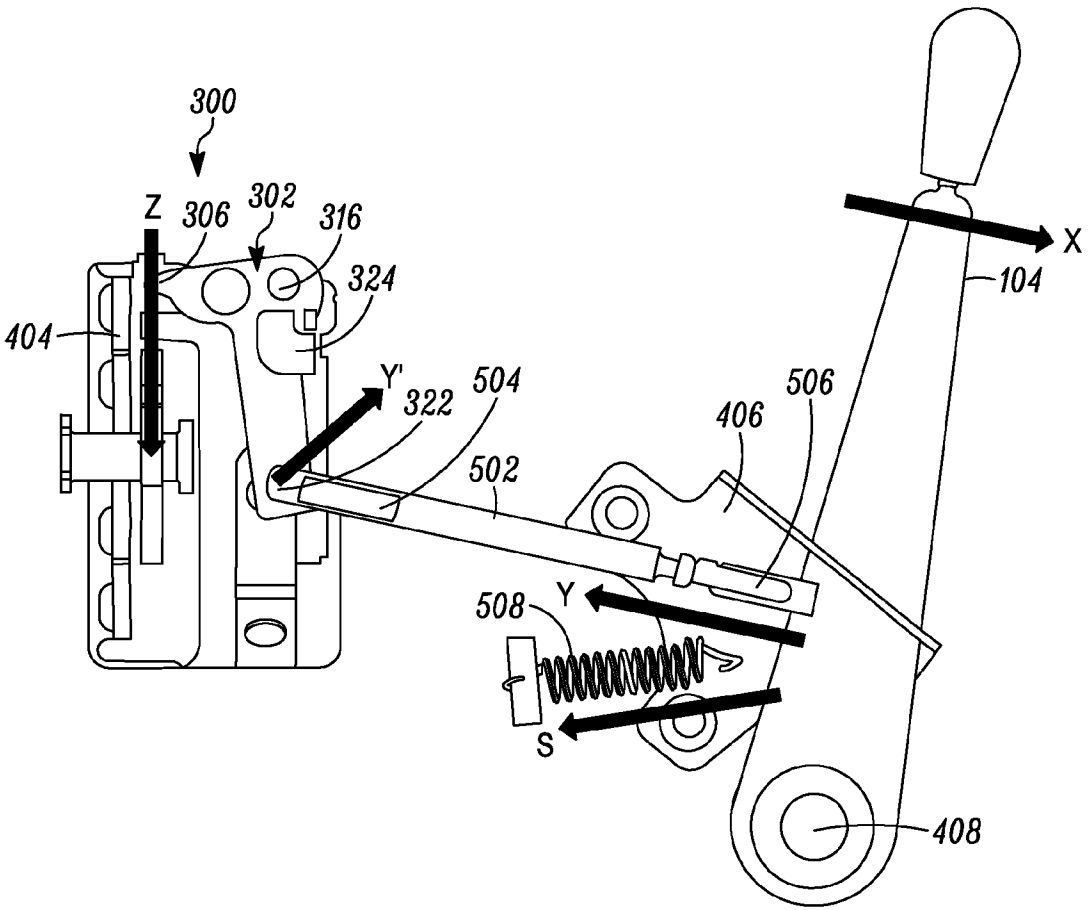
FIG. 8 is a diagrammatic view of direction of forces when the first handle is used by an operator.

FIGS. 6-7 illustrate different views of the actuator mechanism 300 coupled to the latch 404. FIG. 8 illustrates the direction of forces when the operator uses the first handle 104 to open the door 100. The operator may exert the first actuation force in a direction marked X, causing the first handle 104 to rotate about a pivot point defined by the boss 408. A person of ordinary skill in the art will appreciate that the movement of the first handle 104 may take place within the slot 507 of the third support structure 406.

In one example, the first actuation force exerted by the operator can be less than 100 N. Further, the rotation of the first handle 104 may cause the connecting rod 502 to move relative to the second axis BB. Direction of forces acting on either ends 504, 506 of the connecting rod 502 are depicted as Y and Y' in FIG. 8. Also, in one embodiment, the biasing member 508 may exert a force in a direction S which is opposite to the force exerted on the first engagement 322. When the biasing member 508 is a return spring, a magnitude of the force exerted in the direction S may be based on the spring rate and the spring stretch. In one embodiment, the movement of the connecting rod 502 causes the rotation of the first actuator 302 about the first axis AA. To this end, the first actuator 302 may move in an counterclockwise direction about the first axis AA to cause a force in a direction Z to be exerted by the engaging tip 306 of the first actuator 302 on the latch 404. The movement of the engaging tip 306 may cause the latch 404 to release. The releasing of the latch is described in connection with FIGS. 11-12. In one example, the first handle 104 and the first actuator 302 may be arranged to provide a ratio (force input/force output) of mechanical advantage of about 1:6. For example, when frictional forces are negligible, the first actuation force of approximately 60 N results in a force of approximately 359 N applied by the engaging tip 306 to release the latch 404. Other desired mechanical advantages may be achieved with the design.

Figure 9:
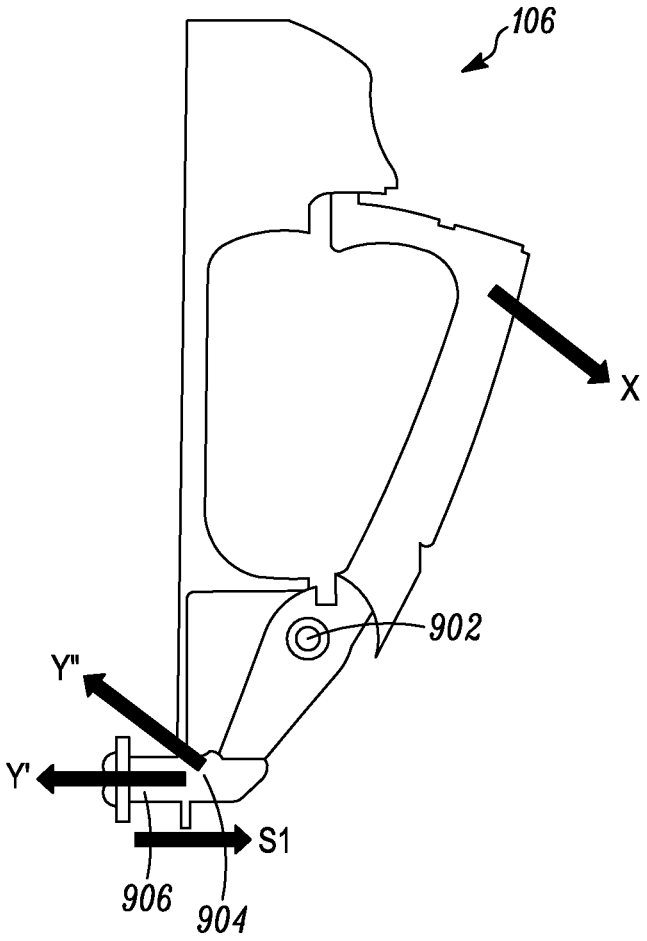
FIGS. 9-10 are diagrammatic views of direction of forces when the second handle is used by the operator.
Figure 10:
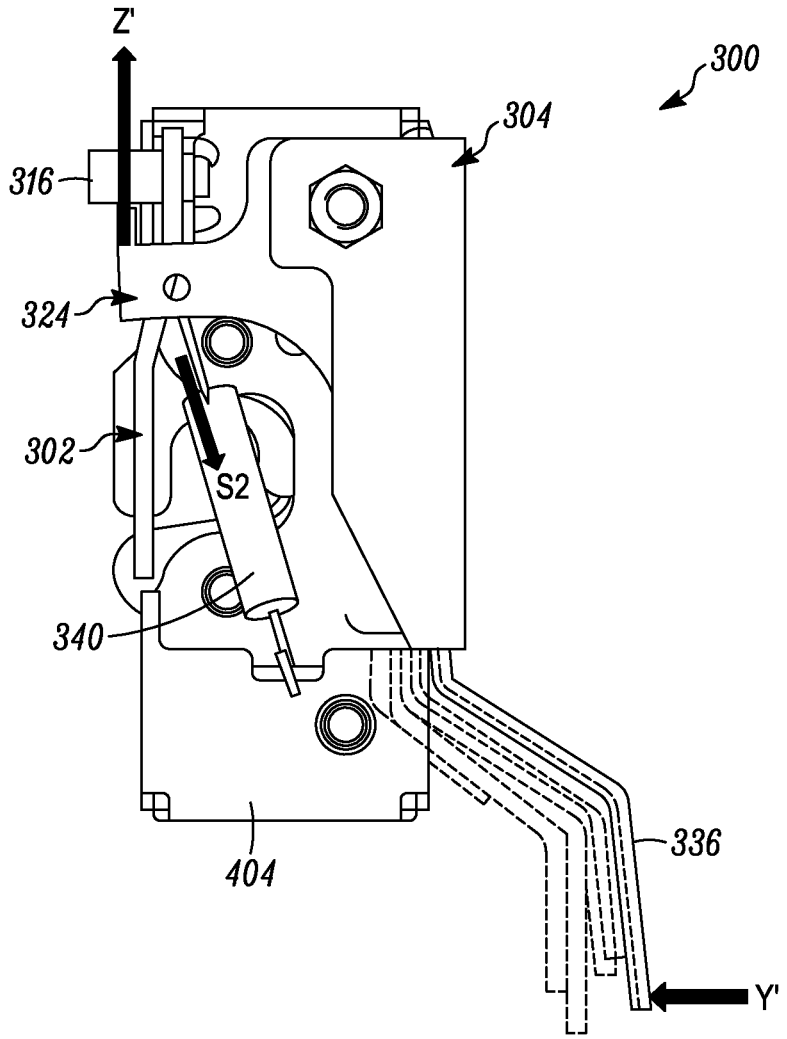

FIGS. 9-10 illustrate the use of the second handle 106 to open the door 100. In one embodiment, the operator may apply the second actuation force in direction marked as X, as shown in FIG. 9. In one example, the second actuation force may be less than 100 N. In response to the second actuation force, the second handle 106 may rotate about the second axis BB, about a pivot point 902. In another embodiment, a biasing member such as a return spring may be coupled to second handle 106 to allow the second handle 106 to return to an initial position.

Moreover, a portion 904 of the second handle 106 may be selectively in contact with the tip 412 of the lever member 336 of the second actuator 304. For example, the portion 904 of the second handle 106 may include a plunger 906. The plunger 906 may include a plastic cylinder and a washer. On rotation of the second handle 106 about the pivot point 902, the plunger 906 may exert a force on the tip 412 of the lever member 336 in a direction Y'. The dotted lines in FIG. 10 depict the movement of the lever member 336 on application of the force at the tip 412 of the lever member 336 by the plunger 906. The lateral displacement of the lever member 336 may be within a range between 10 mm and 13 mm. This design of the actuator mechanism 300 may be based on limited space provided by current door designs.

In one embodiment, in response to the movement of the lever member 336, the second actuator 304 is made to rotate about the second axis BB in a clockwise direction. The arm 324 of the second actuator 304 may exert a force on the first engagement 316 of the first actuator 302 in an upward direction, causing the first actuator 302 to rotate about the first axis AA in a counterclockwise direction. In one embodiment, the biasing member 340 may urge the second actuator 304 to return to its initial position by exerting a force in direction S2. The rotation of the first actuator 302 further can cause a force to be exerted by the engaging tip 306 in the downward direction thereby releasing the latch 404.

It should be noted that a length of the first actuator 302 from the first end 312 to the second end 314 may be based on the maximum lateral displacement of the lever member 336 that can be accommodated by the door design. A person of ordinary skill in the art will appreciate that if the length of the first actuator 302 were increased, then more travel would be required by the lever member 336 to release the latch 404. In one embodiment, the second handle 106 and the first actuator 302 may be arranged to provide a ratio (force input/force output) of mechanical advantage of about 1:4. For example, when frictional forces are negligible, the second actuation force of approximately 60 N results in a force of approximately 246 N applied by the engaging tip 306 to release the latch 404.

Figure 11:
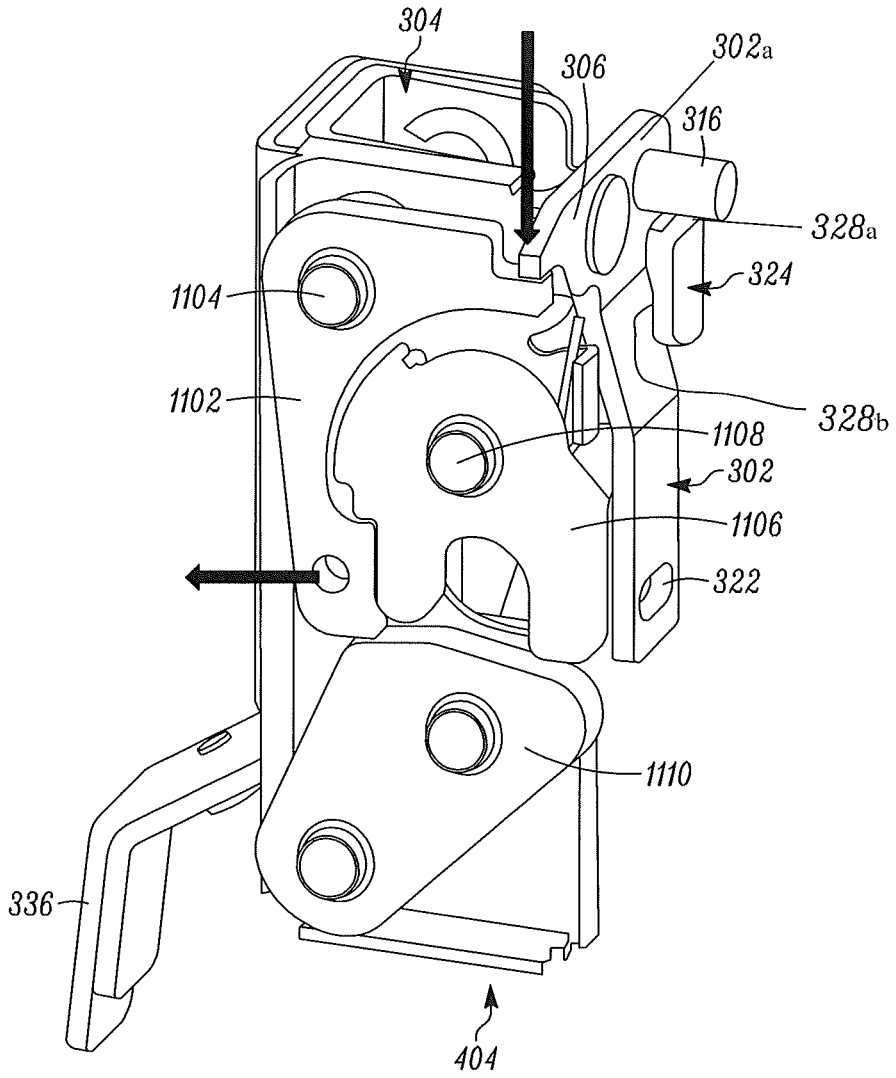
FIG. 11 is an inside view of the latch in a latching condition.
Figure 12:
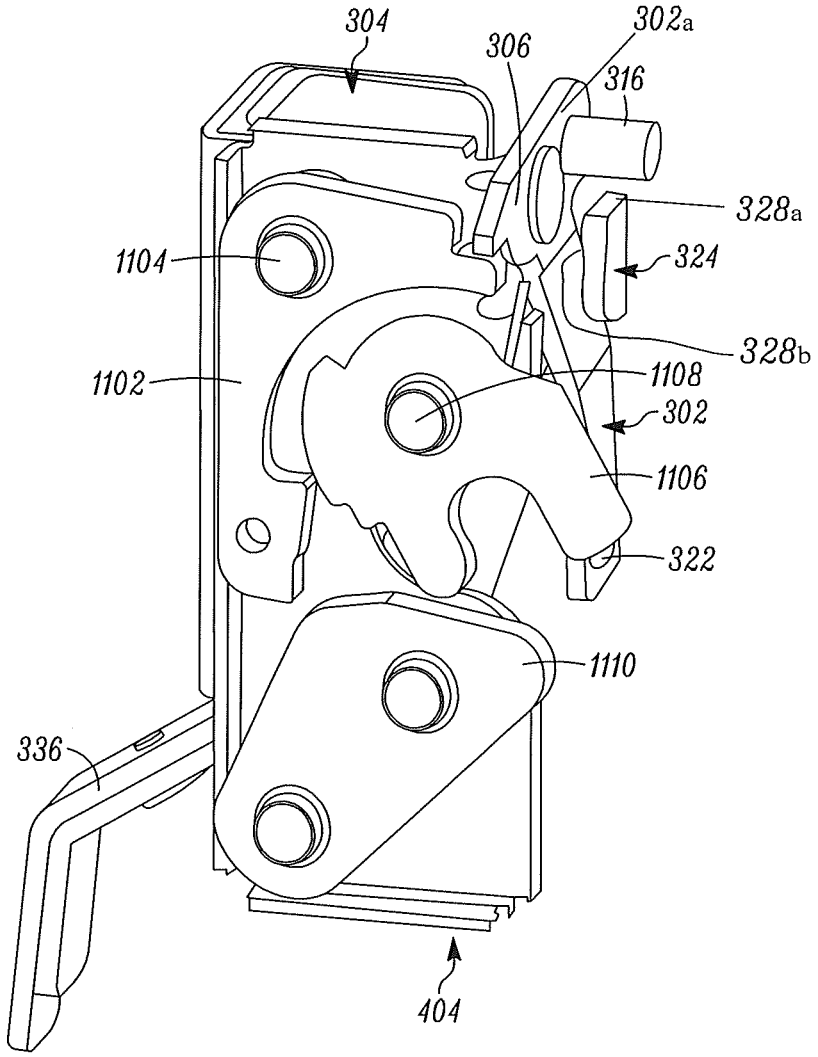
FIG. 12 is an inside view of the latch in an unlatching condition.
Figure 13:
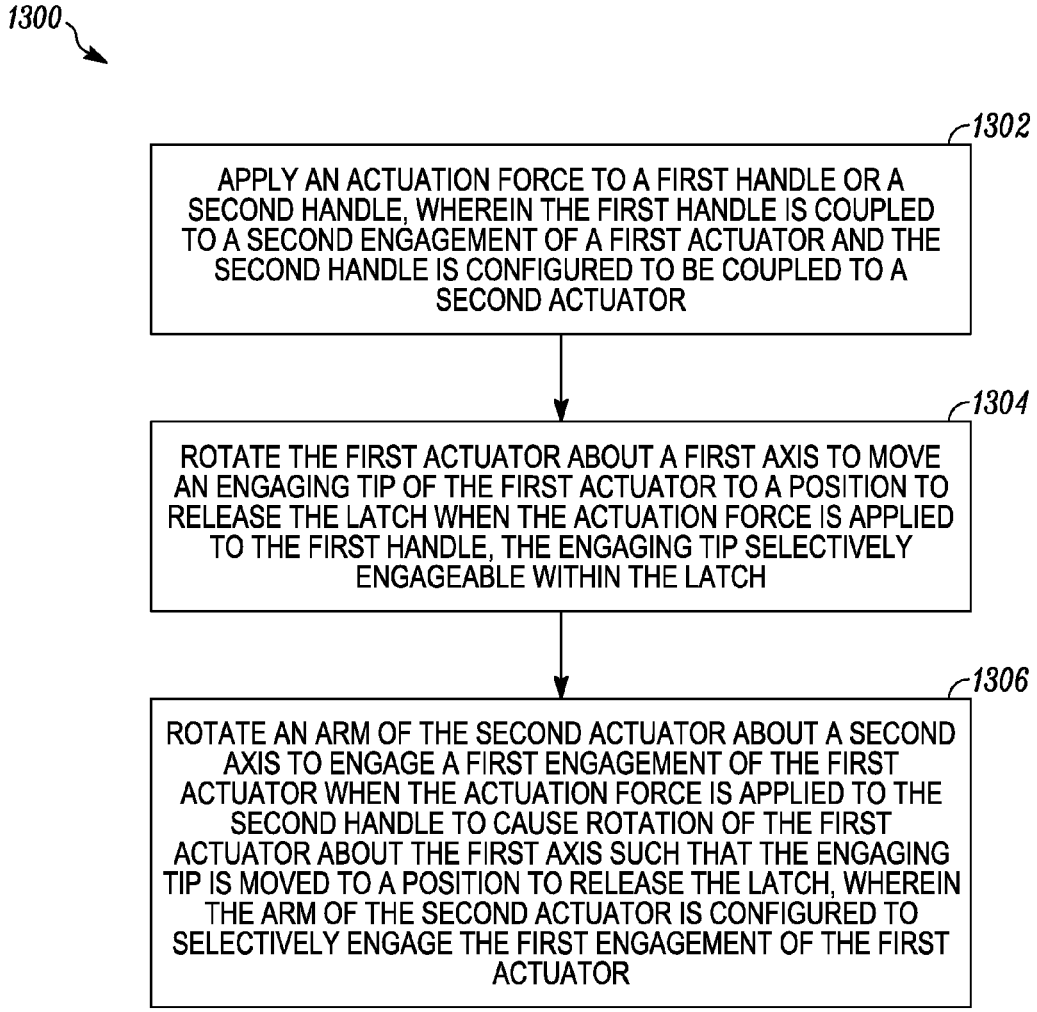
FIG. 13 is a process for releasing the latch.

FIGS. 11-12 illustrate an inside view of the latch 404. As shown, the latch may include one or more components. In one embodiment, the one or more components may include a catch 1102 pivotable about a first pin 1104, a rotor 1106 pivotable about a second pin 1108 and a stationary plate 1110. FIG. 11 illustrates the latch 404 in a locking position. The rotor 1106 as shown may be initially engaged within the catch 1102. In another embodiment, in response to a force exerted in the downward direction by the engaging tip 306 on the catch 1102, the catch 1102 may rotate about the first pin 1104 in the clockwise direction. Due to the rotation of the catch 1102, the rotor 1106 may be disengaged from the catch 1102, causing the rotor 1106 to rotate in the counterclockwise direction about the second pin 1108. Thus, the latch 404 is in an unlatching position as shown in FIG. 12, leading to opening of the door 100. It should be noted that the rotor 1106 and the catch 1102 can include torsion springs configured to generate rotational and torsional forces in order to retain the one or more components of the latch 404 in the unlatching condition. A person of ordinary skill in the art will appreciate that the latch 404 described herein is merely on an exemplary basis and does not limit the scope of this disclosure.

INDUSTRIAL APPLICABILITY

Currently used external handles require excessive handle effort to open the door. Less mechanical advantage and friction between components of the latch 404 may be considered as factors that resulted in this requirement. The actuator mechanism 300 provided in the present disclosure is configured to provide reduced handle effort to open the door 100, such as, for example, by increasing the mechanical advantage by about 1:4 for the second handle 106 and 1:6 for the first handle 104.

At step 1302, the operator may apply the first actuation force on the first handle 104, or alternatively, the operator may apply the second actuation force on the second handle 106. As described earlier, the first handle 104 may be coupled to the second engagement 322 of the first actuator 302. Also, the second handle 304 may be coupled to the second actuator 304.

At step 1304, the first actuator 302 may rotate about the first axis AA to move the engaging tip 306 of the first actuator 302 to a position to release the latch 404 when the first actuation force is applied to the first handle 104. The engaging tip 306 may be selectively engageable within the latch 404.

Alternatively, at step 1306, the arm 324 of the second actuator 304 may be rotated about the second axis BB to engage the first engagement 316 of the first actuator 302 when the second actuation force is applied to the second handle 106. This in turn may cause rotation of the first actuator 302 about the first axis AA such that the engaging tip 306 is moved to a position to release the latch 404. The second actuator 304 can be configured to selectively engage the first engagement 316 of the first actuator 302.

A person of ordinary skill in the art will appreciate that the first and second handles 104, 106 can actuate the actuator mechanism 300 independent from one another to release the latch 404. It should be noted that the shape and location of the first and second actuators 302, 304, location of the pivot pin 332, the biasing member 340, and the like, can be selected to improve the mechanical advantage provided by the actuator mechanism 300 described herein. Friction between the components of the actuator mechanism 300 may be reduced, for example, by hardening the materials of the components, when metallic, such as the second actuator 304, adding a washer at the end of the plunger 904, lubricating the components with grease, and the like.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. An actuator mechanism for a door latch comprising:

a first actuator pivotably coupled to a first support structure about a first axis, the first actuator having an engaging tip to release a door latch, a first engagement spaced from the first axis and extending from a surface of the first actuator on a first side of the first actuator in a first direction along the first axis, and a second engagement spaced from the first axis;

a second actuator pivotably coupled to a second support structure about a second axis positioned on a second side of the first actuator opposite to the first side, the second axis perpendicular to the first axis, the second actuator including an arm extending from a portion of the second actuator on the second side, the arm extending in the first direction across the first actuator to selectively engage the first engagement on the first side, wherein in response to movement of the arm of the second actuator about the second axis, the first engagement of the first actuator rotates about the first axis to move the engaging tip to release the door latch, and wherein in response to movement of the first actuator via the second engagement of the first actuator, the second engagement of the first actuator rotates about the first axis to move the engaging tip to release the door latch.

2. The actuator mechanism of claim 1, wherein the first axis of rotation is positioned between the engaging tip and the first engagement.

3. The actuator mechanism of claim 1, wherein the first engagement includes a protrusion, wherein the arm includes an engaging surface and a non-engaging surface, the engaging surface connected to the non-engaging surface on the first side of the first actuator, wherein the engaging surface engages the protrusion along a third axis that is perpendicular to the first axis and the second axis, and wherein the non-engaging surface extends in a second direction along the third axis and faces the surface on the first side of the first actuator.

4. The actuator mechanism of claim 1, wherein the arm includes a first portion extending in the first direction from the second side across the first actuator to the first side, and a second portion that extends from the first portion in a direction along the second axis, wherein the second portion engages the first engagement on the first side of the first actuator to selectively move the first engagement along a third axis, and wherein the third axis is perpendicular to the first axis and the second axis.

5. The actuator mechanism of claim 1, wherein the second engagement is spaced from the first axis along a third axis.

6. The actuator mechanism of claim 1, wherein the second engagement is selectively moveable along the second axis.

7. The actuator mechanism of claim 1, wherein the first actuator includes a first leg and a second leg coupled to one another in an intersecting manner, wherein the first leg includes a first end having the engaging tip and a second end having the first engagement, wherein the second leg includes a first end coupled between the first and second ends of the first leg and a second end having the second engagement.

8. The actuator mechanism of claim 1, wherein the second actuator includes a housing.

9. The actuator mechanism of claim 1, wherein the second actuator includes a lever member extending away from the first actuator along a third axis.

10. A door latching system comprising:

a latch;

a first handle;

a second handle;

a first actuator pivotably coupled to a first support structure about a first axis, the first actuator having an engaging tip to selectively release the latch, a first engagement spaced from the first axis and extending from a surface of the first actuator on a first side of the first actuator in a first direction parallel to the first axis, and a second engagement spaced from the first axis;

a second actuator pivotably coupled to a second support structure about a second axis positioned on a second side of the first actuator opposite to the first side, the second axis perpendicular to the first axis, the second actuator including an arm extending from a portion of the second actuator on the second side, the arm extending in the first direction across the first actuator to selectively engage the first engagement on the first side;

a connecting rod coupled between the first handle and the second engagement of the first actuator;

a lever member extending between the second handle and the second actuator; and wherein in response to the movement of the first handle or the second handle, the first actuator rotates about the first axis to move the engaging tip to release the latch.

11. The door latching system of claim 10, wherein each of the first handle and the second engagement includes a slot sized to permit movement of a respective coupling end of the connecting rod.

12. The door latching system of claim 10, wherein the connecting rod is disposed relative to the second axis.

13. The door latching system of claim 10, wherein a portion of the second handle engages a tip of the lever member.

14. The door latching system of claim 10, wherein the lever member is fixed in a secure manner with the second actuator.

15. The door latching system of claim 10, further comprising a catch pivotably coupled to a pin extending from the latch along an axis parallel to the second axis, wherein the catch is engaged with the engaging tip and rotates about the pin in response to the first actuator rotating about the first axis.

16. The door latching system of claim 10, wherein in response to the movement of the second handle, the lever member causes rotation of the second actuator about the second axis such that the arm rotates the first engagement of the first actuator about the first axis to move the engaging tip to release the latch.

17. The door latching system of claim 10, wherein in response to the movement of the first handle, the connecting rod causes rotation of the second engagement of the first actuator about the first axis to move the engaging tip to release the latch.

18. The door latching system of claim 10, wherein the first handle and the first actuator are arranged to provide a ratio (force input/force output) of mechanical advantage of about 1:6.

19. The door latching system of claim 10, wherein the second handle and the first actuator are arranged to provide a ratio (force input/force output) of mechanical advantage of about 1:4.

20. A method for releasing a latch of a door latching system including a first handle, a second handle, a first actuator that is coupled to the first handle and rotates about a first axis, and a second actuator that is configured to be coupled to the second handle and rotates about a second axis that is positioned on a second side of the first actuator and is perpendicular to the first axis, the method for releasing the latch comprising:

applying an actuation force to the second handle that rotates the second actuator about the second axis;

engaging a first engagement of the first actuator with an arm of the second actuator rotating about the second axis, the first engagement extending in a first direction along the first axis from a surface of the first actuator on a first side of the first actuator, the arm extending in the first direction from a portion of the second actuator on the second side across the first actuator to selectively engage the first engagement on the first side; and rotating the first actuator about the first axis in response to the engaging the first engagement with the arm, the first actuator rotating about the first axis to move an engaging tip of the first actuator to a position to release the latch, the engaging tip selectively engageable within the latch.

* * * * *